US007650865B2

(12) United States Patent
Kohls

(10) Patent No.: US 7,650,865 B2
(45) Date of Patent: Jan. 26, 2010

(54) POWER EQUIPMENT APPARATUS HAVING ENGINE WITH ELECTRIC STARTER MOTOR AND MANUAL STARTER MECHANISM

(75) Inventor: Mark T. Kohls, Marysville, OH (US)

(73) Assignee: Honda Motor Company, Ltd., Tokyo (JP)

( * ) Notice: Subject to any disclaimer, the term of this patent is extended or adjusted under 35 U.S.C. 154(b) by 337 days.

(21) Appl. No.: 11/800,619

(22) Filed: May 7, 2007

(65) Prior Publication Data

US 2008/0276891 A1 Nov. 13, 2008

(51) Int. Cl.
*F02N 11/08* (2006.01)
*F02N 3/04* (2006.01)
*F02N 3/02* (2006.01)

(52) U.S. Cl. ..... 123/179.24; 123/179.3

(58) Field of Classification Search ..... 123/179.3, 123/179.24; 701/113, 114
See application file for complete search history.

(56) References Cited

U.S. PATENT DOCUMENTS 3,415,999 A * 12/1968 Noury ..... 123/179.3
3,656,465 A * 4/1972 Frankle ..... 123/179.21
3,809,045 A * 5/1974 Frankle ..... 123/179.1
4,344,392 A * 8/1982 Iijima et al. ..... 123/179.16
4,494,162 A * 1/1985 Eyler ..... 123/179.1
4,662,333 A * 5/1987 Martel ..... 123/179.18
4,674,344 A * 6/1987 Kazino et al. ..... 290/38 R
4,731,601 A * 3/1988 Nowakowski et al. ..... 340/439
4,754,730 A * 7/1988 Campagna ..... 123/179.3
4,805,716 A * 2/1989 Tsunoda et al. ..... 180/219
5,088,464 A 2/1992 Meaney
5,349,931 A * 9/1994 Gottlieb et al. ..... 123/179.2
5,408,975 A 4/1995 Blakeslee et al.
5,555,871 A 9/1996 Gopp et al.
5,716,134 A * 2/1998 Wagner et al. ..... 374/141
6,050,233 A * 4/2000 Vilou ..... 123/179.3
6,109,121 A 8/2000 Brown
6,354,257 B1 * 3/2002 Marshall et al. ..... 123/179.3
6,561,151 B1 * 5/2003 Wisnia et al. ..... 123/179.2
6,637,395 B1 10/2003 Olson et al.
6,845,313 B2 1/2005 Hasegawa et al.
6,849,024 B2 2/2005 Hayashi et al.
7,140,339 B1 * 11/2006 Smith ..... 123/179.3
7,503,506 B2 * 3/2009 Harada et al. ..... 235/492
2004/0186656 A1 * 9/2004 Nishiyama ..... 701/113
2004/0206326 A1 * 10/2004 North ..... 123/179.18

(Continued)

FOREIGN PATENT DOCUMENTS

EP 244521 A1 * 11/1987

(Continued)

*Primary Examiner*—Stephen K Cronin
*Assistant Examiner*—Arnold Castro
(74) *Attorney, Agent, or Firm*—Ulmer & Berne LLP

(57) ABSTRACT

A power equipment apparatus includes an engine, an electric starter motor, a manual starter mechanism, a temperature sensor, and a starter switch. The temperature sensor is operatively coupled with the engine and is configured to generate a temperature signal reflecting a temperature of a portion of the engine. The starter switch is configured to selectively facilitate passage of electrical power to the electric starter motor for actuation of the electric starter motor only when both the starter switch is actuated and the temperature exceeds a predetermined temperature.

21 Claims, 4 Drawing Sheets

U.S. PATENT DOCUMENTS

2004/0237924 A1 12/2004 Sakurai
2004/0255890 A1 12/2004 Tsutsumi et al.
2005/0103301 A1* 5/2005 Namari et al. ..... 123/179.3
2005/0140332 A1* 6/2005 Shiokawa et al. ..... 320/104
2005/0155581 A1 7/2005 Wells et al.
2005/0247281 A1* 11/2005 Honbo et al. ..... 123/179.4
2006/0261146 A1* 11/2006 Harada et al. ..... 235/375
2007/0240663 A1* 10/2007 Hiramatsu ..... 123/179.6

FOREIGN PATENT DOCUMENTS

KR 2002-0074882 10/2002

* cited by examiner

POWER EQUIPMENT APPARATUS HAVING ENGINE WITH ELECTRIC STARTER MOTOR AND MANUAL STARTER MECHANISM

TECHNICAL FIELD

The present invention relates to a power equipment apparatus having an engine. An electric starter motor and a manual starter mechanism are provided for selectively starting the engine, but the electric starter motor is only operative to start the engine when the temperature of the engine exceeds a predetermined temperature.

BACKGROUND OF THE INVENTION

An engine of a power equipment apparatus can be started in any of a variety of conventional manners. For example, a conventional motorcycle can be provided with an engine, a battery and an electric starter motor. In this configuration, an operator of the motorcycle can press a start button or switch to effect flow of electrical power from the battery to the electric starter motor. This flow of electrical power results in rotation of the electric starter motor, and resultant starting of the engine. While generally effective to conveniently start an engine, a conventional battery and electric starter motor arrangement is generally quite large and bulky, and is therefore often not desired upon high-performance, racing-type motorcycles.

As another example, a conventional motorcycle can be provided with an engine and a kick-starter. In this configuration, an operator of the motorcycle can start the engine by rapidly and forcefully depressing a kick pedal. Accordingly, a motorcycle having kick-start capability need not include a battery or electric starter motor, and can therefore have reduced weight and bulk as compared to motorcycles having an electric start system. However, kick-starting can require significant energy from an operator, and repeated kick-starts of an engine can result in fatigue of an operator. Also, in contrast to electric starting of an engine present upon a motorcycle, kick-starting requires an operator to bring the motorcycle to a complete stop, and to then direct her full attention to the kick starting technique, which resultantly can cost valuable time and attention in a racing condition.

SUMMARY OF THE INVENTION

In accordance with one embodiment of the present invention, a power equipment apparatus comprises an engine, a battery, an electric starter motor, a manual starter mechanism, a temperature sensor, and a starter switch. The engine has a crankshaft. The electric starter motor is operatively coupled with the engine and is configured to selectively initiate rotation of the crankshaft upon receipt of electrical power from the battery. The manual starter mechanism comprises an actuator, is operatively coupled with the engine, and is configured to selectively initiate rotation of the crankshaft upon movement of the actuator by an operator. The temperature sensor is operatively coupled with the engine and is configured to generate a temperature signal reflecting a temperature of a portion of the engine. The starter switch is configured for selective actuation by an operator. The starter switch is configured to selectively facilitate passage of electrical power from the battery to the electric starter motor for actuation of the electric starter motor only when both the starter switch is actuated and the temperature exceeds a predetermined temperature.

In accordance with another embodiment of the present invention, a vehicle comprises an engine, a battery, an electric starter motor, a kick pedal, a temperature sensor, and a starter switch. The electric starter motor is operatively coupled with the engine and is configured to selectively facilitate electric starting of the engine. The kick pedal is operatively coupled with the engine and is configured to selectively facilitate kick starting of the engine. The temperature sensor is operatively coupled with the engine and includes contacts configured to selectively close during exposure of the temperature sensor to a temperature exceeding a predetermined temperature. The starter switch includes contacts configured to selectively close during actuation of the starter switch by an operator. A relay has a control contact, a power input contact, and a power output contact. The power input contact is connected for receiving electrical power from the battery. The power output contact is connected for providing electrical power to the electric starter motor.

In accordance with yet another embodiment of the present invention, a power equipment apparatus comprises an engine, means for manually starting the engine, and means for detecting a temperature of a portion of the engine. The power equipment apparatus further comprises means for selectively electrically starting the engine being operative only when the temperature exceeds a predetermined temperature.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EMBODIMENTS

The present invention and its operation are hereinafter described in detail in connection with the views of FIGS. 1-4, wherein like numbers indicate the same or corresponding elements throughout the views. A power equipment apparatus in accordance with the present invention can comprise an automobile, truck, van, motorcycle, recreational vehicle, watercraft, aircraft, agricultural equipment, construction equipment, toy, ATV, mower, generator, pressure washer, snow blower, snowmobile, or any of a variety of other vehicles, tools, or machines having an engine.

Figure 1:
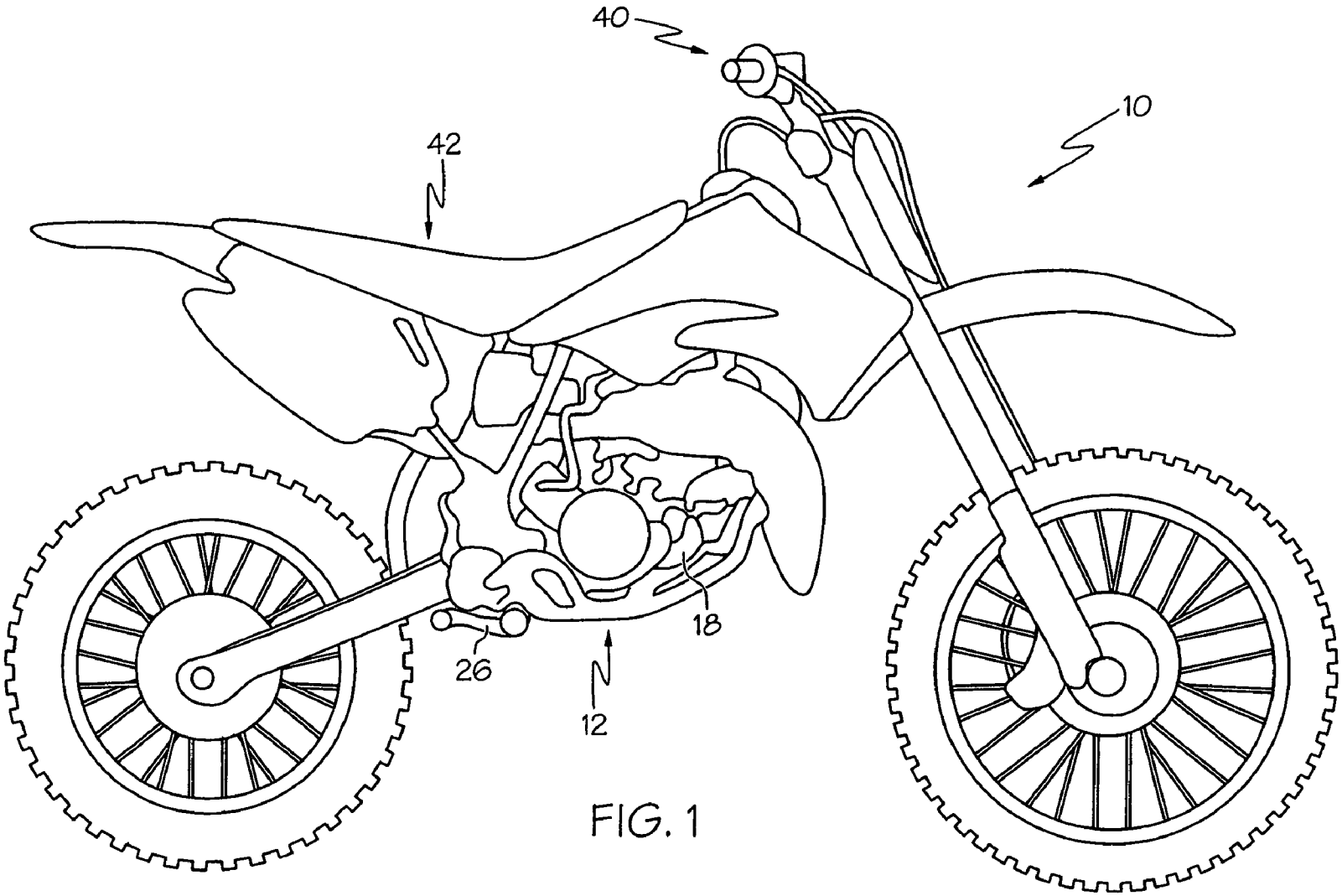
FIG. 1 is a side view depicting a motorcycle in accordance with one embodiment of the present invention.

For example, FIG. 1 depicts a motorcycle 10 having an engine 12 in accordance with one embodiment of the present invention. It will be appreciated that the engine 12 can comprise, for example, an internal combustion engine having one or more pistons. The engine 12 can be configured to consume any of a variety of fuels including, for example, gasoline, diesel fuel, kerosene, jet fuel, alcohol, natural gas, propane, and hydrogen. The motorcycle 10 of FIG. 1 includes a manual starter mechanism (having a kick pedal 26) and an electric starter motor 18. The manual starter mechanism is operatively coupled with the engine 12 and is configured to selectively initiate rotation of the engine's crankshaft (14 in FIG. 2) upon movement of the kick pedal 26 by an operator of the motorcycle 10. The electric starter motor 18 is operatively coupled with the engine 12 and is configured to selectively initiate rotation of the engine's crankshaft (14 in FIG. 2) upon receipt of electrical power from a battery (16 in FIG. 2). The motorcycle 10 is also shown to include a seat 42 which is configured to support an operator during use of the motorcycle 10, as well as a handlebar 40 which facilitates steering of the motorcycle 10 by an operator.

An operator can start the engine 12 through use of the kick pedal 26, regardless of whether the engine 12 is hot or cold. However, when the engine 12 is already heated up (as would be the case after running the engine for some time), an operator can cause the electrical starter motor 18 to start the engine 12. In one embodiment, the operator can engage a starter switch (24 in FIG. 2). Upon engagement of the starter switch, electrical power can be provided to the electric starter motor 18, and the engine 12 can thereby be started. In one embodiment of the present invention, an indicator (e.g., 30 in FIG. 2) can provide indicia to an operator of the motorcycle 10 as to whether the engine 12 is heated, and thus whether the electric starter motor 18 is available for starting the engine 12. The starter switch and/or the indicator can be provided upon a handlebar (e.g., 40 in FIG. 1) or another portion of a power equipment apparatus.

Figure 2:
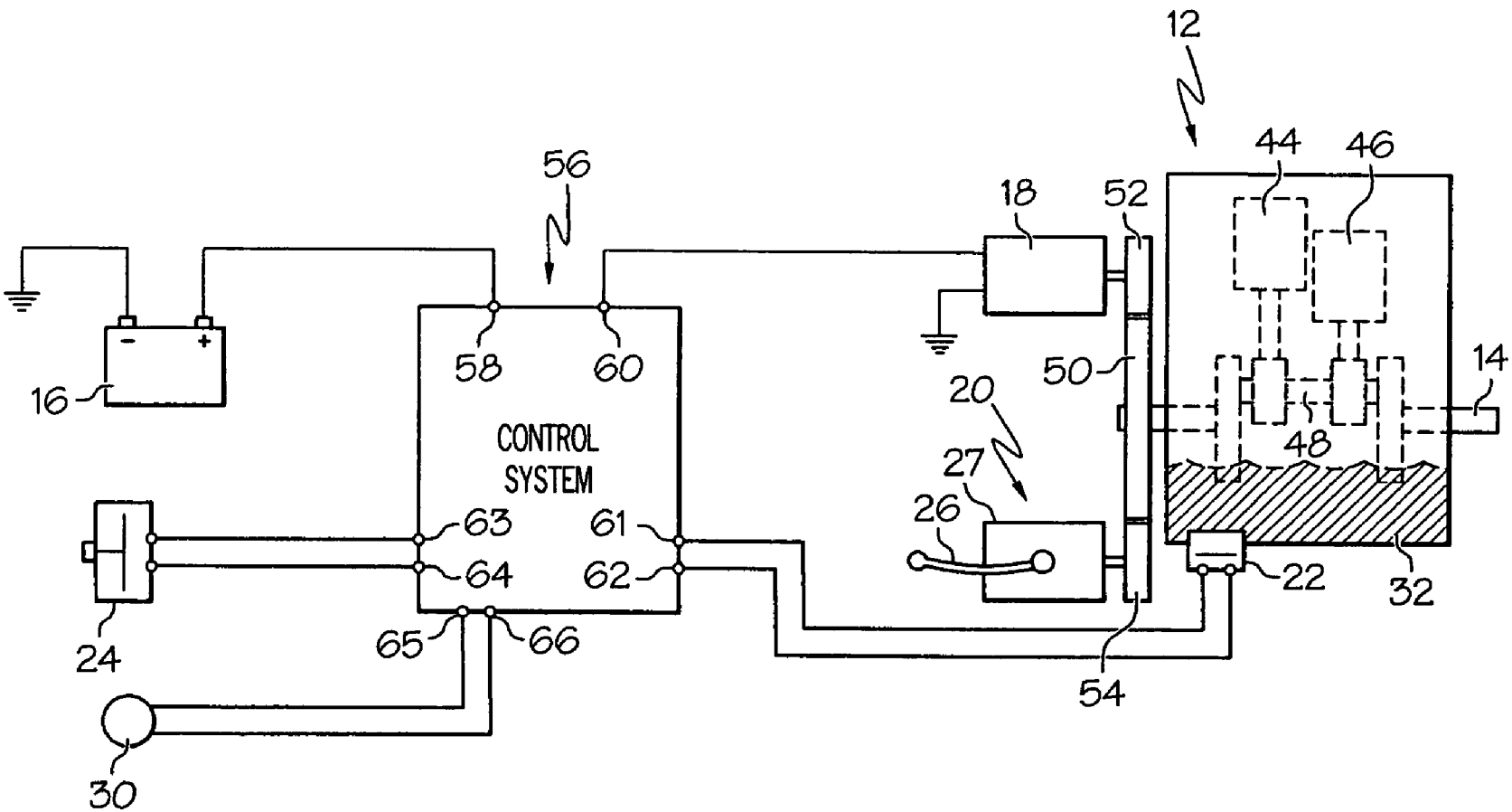
FIG. 2 is a schematic view depicting certain components of the motorcycle of FIG. 1.
Figure 3:
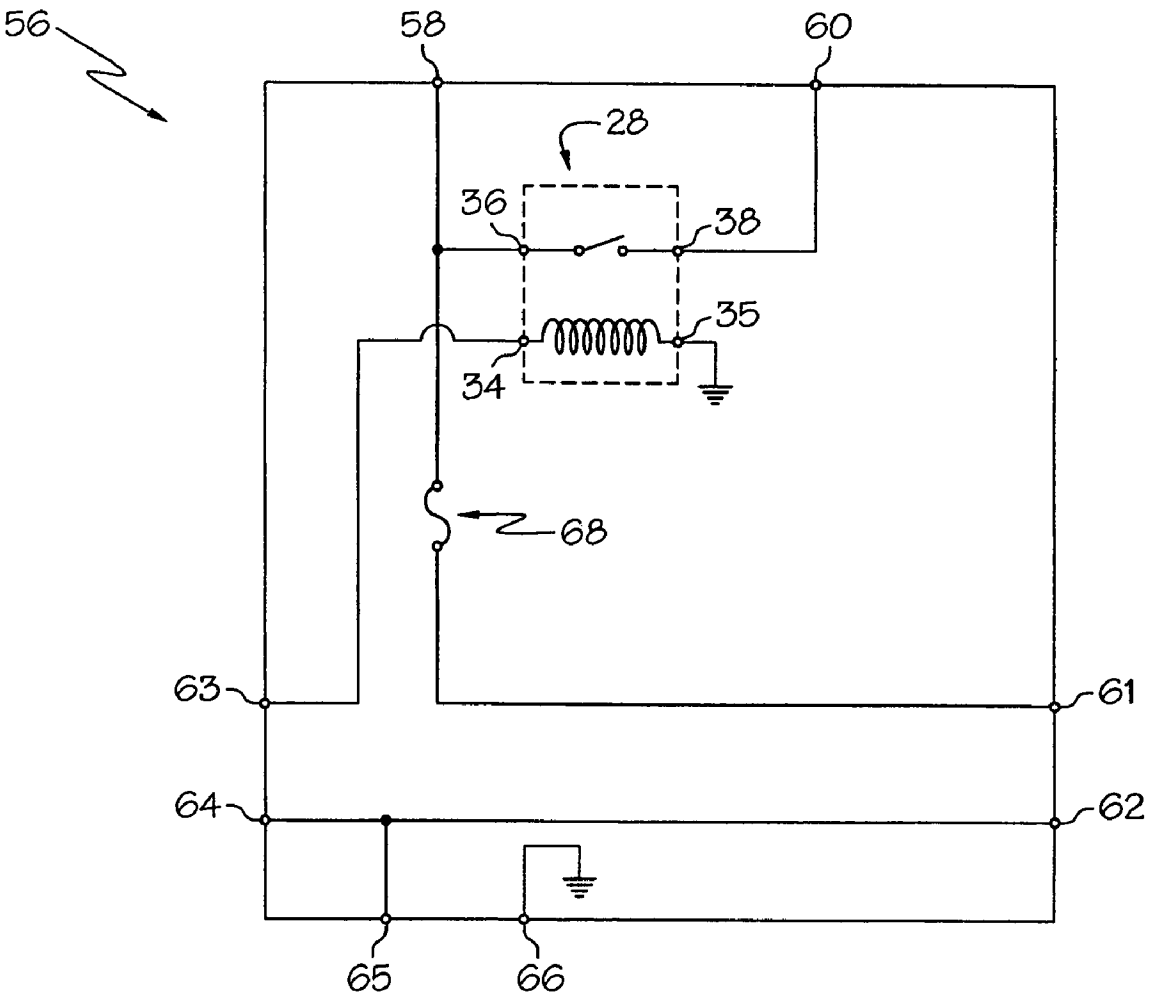
FIG. 3 is a schematic view depicting internal components of the control system of FIG. 2 in accordance with one embodiment of the present invention.

It will be appreciated that the starter switch can comprise a pushbutton, a rotary switch, a key-type switch, a toggle-type switch, a rocker-type switch, a push-pull type switch, and or any of a variety of other alternative switch arrangements. The starter switch can be configured for selective actuation by an operator. As shown in the embodiment of FIGS. 2-3, the starter switch 24 can be configured to selectively facilitate passage of electrical power from the battery 16 to the electric starter motor 18 for actuation of the electric starter motor 18 only when both the starter switch 24 is actuated and the temperature exceeds a predetermined temperature.

The indicator can comprise any of a variety of suitable devices configured to identify to an operator the temperature of at least a portion of an engine relative to a predetermined temperature. For example, the indicator can comprise a light emitting diode ("LED") or incandescent lamp, and might only illuminate when the temperature of the engine is greater than the predetermined temperature. In an alternative embodiment, an LED or incandescent lamp only illuminates when the temperature of the engine is below a predetermined temperature. In still another embodiment, an LED or incandescent lamp only illuminates whenever a key switch for the power equipment apparatus is activated, the engine is not running, and the temperature of the engine is above a predetermined temperature. In such a configuration, the indicator would only illuminate when the electric starter motor is available and appropriate for starting the engine. In alternative embodiments, it will be appreciated that the indicator can comprise a meter, an electromechanical indicator, an audible indicator (e.g. a buzzer), and/or any of a variety of other devices. In still another embodiment, the indicator can be incorporated into an existing liquid crystal panel, vacuum fluorescent display, or other display present upon a power equipment apparatus.

A power equipment apparatus in accordance with the teachings of the present invention can assume any of a variety of particular configurations provided that, however, the engine present upon the power equipment apparatus is only capable of being electrically started when at least a portion of the engine has a temperature greater than a predetermined temperature. Considerably more power is required to start a cold engine than to start an engine which is already heated. Conventional vehicles equipped with electrical starting components have been designed such that those electrical starting components are of sufficient power capacity to start the engine regardless of whether the engine is cold or hot. Accordingly, as such components must be capable of cold starting the engine, they have a power capacity much greater than that typically required to start an already heated engine.

Conversely, a power equipment apparatus in accordance with the teachings of the present invention includes an electrical starting system, but does not include much of the additional power capacity present in conventional systems which is not required to start an already heated engine, but which is necessary to start a cold engine. In particular, at least one of the battery and the electric starter motor of a power equipment apparatus in accordance with one embodiment of the present invention are of insufficient power capacity to initiate cold starting of an engine present upon the power equipment apparatus. Appropriate safeguards can be provided to prevent attempted use of the electrical starting components to start a cold engine, as attempted use of the electrical starting components to cold start an engine would typically be ineffective to start the engine and could result in overload and damage to the electrical starting components. A manual starter mechanism is thus relied upon for cold starting the engine and, in certain circumstances, may also be available as a redundancy to the electrical starting system for starting an engine which has already been heated.

Accordingly, an electrical starting system of a power equipment apparatus in accordance with one embodiment of the present invention can have a reduced power capacity as compared to an electrical starting system of a conventional power equipment apparatus. For example, 2500 Watts of electrical power might be required to start an engine on a conventional motorcycle when the engine is cold, while only 1000 Watts of electrical power might be required to start the engine when the engine is heated. The conventional motorcycle would accordingly include a battery capable of providing 2500 Watts and a starter motor rated for consuming 2500 Watts, which together can operate for a sufficient length of time to start the engine regardless of whether the engine is cold or hot. However, a motorcycle in accordance with the teachings of the present invention might include an electric starter motor capable of consuming only about 1000 Watts, and a battery capable of providing only about 1000 Watts, both for a sufficient time to facilitate hot starting (but not cold starting) of the engine.

By reducing the power capacity of the electric motor, the battery, and associated wiring and control devices, significant weight, cost and bulk savings can be obtained. These savings can be beneficial for many different types of power equipment apparatus. For example, these savings can be particularly beneficial upon a racing motorcycle, wherein efficiencies in weight and bulk can significantly increase performance. Also, with a racing motorcycle, it may not be inconvenient for an operator of the motorcycle to kick start the engine prior to beginning a race although, if the engine of the motorcycle were to stall during the race, restarting of the engine through kick starting might be overly inconvenient and strenuous for an operator of the motorcycle. Accordingly, a motorcycle in accordance with the teachings of the present invention can be manually started by an operator through use of a kick pedal prior to the beginning of a race and, in the event that the engine stalls during race, provided that the engine has already adequately heated, the operator can use the electric starting system to facilitate electric starting of the engine.

Any of a variety of electrical and/or mechanical components can be provided to facilitate this functionality. For example, FIG. 2 is a schematic diagram which depicts a system configuration in accordance with one particular embodiment of the present invention. The engine 12 is represented to include a crankshaft 14 having a crankpin 48 to which two pistons 44, 46 are connected. Part of the crankshaft 14 is shown to reside within an oil bath 32. A flywheel 50 is also shown to be attached to the crankshaft 14. An electric starter motor 18 is shown to have a gear 52 which is drivingly engaged with the flywheel 50. A manual starter mechanism 20 is shown to comprise an actuator (i.e., kick pedal 26) which is attached to a gearbox 27. A gear 54 is attached to the gearbox 27 and is operatively engaged with the flywheel 50. In this configuration, either the electric starter motor 18 or the manual starter mechanism 20 can cause rotation of the flywheel 50, thereby resulting in rotation of the crankshaft 14 and starting of the engine 12. It will be appreciated that an electric starter motor and manual starter mechanism can be mechanically coupled with an engine in any of a variety of alternative configurations.

A temperature sensor 22 is shown in FIG. 2 as being operatively coupled with the engine 12 and is configured to generate a temperature signal reflecting a temperature of a portion of the engine. Although the temperature sensor 22 is shown to at least partially reside within the oil bath 32 for providing a temperature signal reflecting the temperature of the oil bath, it will be appreciated that a temperature sensor in accordance with the teachings of the present invention can alternatively be positioned elsewhere within or with respect to the engine 12 for measuring the temperature of one or more other portions of the engine 12. The temperature sensor 22 is shown to comprise a normally-open type of thermally actuated switch which includes contacts configured to selectively close during exposure of the temperature sensor 22 to a temperature exceeding a predetermined temperature. However, the temperature sensor could alternatively comprise a thermally actuated switch with normally-closed contacts, a thermistor, or any of a variety of other suitable devices. In some embodiments, multiple temperature sensors can be associated with an engine on a power equipment apparatus.

Referring to FIG. 2, the starter switch 24 is shown to comprise a normally-open type pushbutton, but could alternatively comprise any of a variety of other suitable switches, pushbuttons or other control devices. A control system 56 is shown in FIG. 2 to include a terminal 58 for receiving power from the battery 16, wherein the other terminal of the battery 16 can be grounded as shown in FIG. 2. The terminal 60 is shown to be connected to the electric starter motor 18 for providing electrical power to the electric starter motor 18. The other terminal of the electric starter motor 18 is shown to be grounded. The control system 56 is also shown to include terminals 61 and 62 for connection to the temperature sensor 22. The control system 56 is additionally shown to include terminals 63 and 64 for connection to the starter switch 24. Also, the control system 56 is shown to include terminals 65 and 66 for connection to the indicator 30. It will be appreciated that any of a variety of alternative control systems can be provided which include a fewer or greater number of terminals for connection to these and/or other devices present upon a power equipment apparatus in any of a variety of configurations for controlling and/or facilitating starting of an engine present upon a power equipment apparatus.

FIG. 3 depicts a configuration for one particular control system 56 in accordance with the teachings of the present invention. As shown in FIG. 3, a relay 28 has control contacts 34 and 35, a power input contact 36 and a power output contact 38. The power input contact 36 is connected for receiving electrical power from the battery (16 in FIG. 2). The power output contact 38 is connected for providing electrical power to the electric starter motor (18 in FIG. 2). The control contact 34 is connected with a series connection of the temperature sensor (22 in FIG. 2) and the starter switch (24 in FIG. 2). The other control contact 35 of the relay 28 is shown to be grounded. In the particular embodiment shown in FIGS. 2-3, the indicator 30 is shown to have two wires, wherein one of those wires is grounded through the terminal 66, and the other of those wires connects with the output of the temperature sensor 22 (i.e., terminal 62) and with the input of the starter switch 24 (i.e., terminal 64). In the configuration, where the temperature sensor 22 comprises a normally-open type switch which closes when the temperature of the engine rises to a predetermined temperature, and the indicator 30 comprises an LED or incandescent bulb, light will be emitted from the indicator 30 upon closure of the temperature sensor 22, thereby informing an operator that the engine 12 is heated and is thus capable of being electrically started. The relay 28 is thus configured to selectively facilitate passage of electrical power from the battery 16 to the electric starter motor 18 for actuation of the electric starter motor 18 only when both the starter switch 24 is actuated and the temperature exceeds a predetermined temperature. It will be appreciated that a control system can have any of a variety of configurations alternative to that depicted in FIG. 3.

The control system 56 may also include one or more fuses or circuit breakers. For example, a fuse 68 is depicted in FIG. 3 as protecting the temperature sensor 22, the starter switch 24, the indicator 30, the control portion of the relay 28, and the wiring between these components from electrical short circuits or other overloading. In alternative embodiments, additional fuses can be provided or no fuses can be provided, and/or one or more circuit breakers may be provided in lieu of or in addition to fuses.

The operation of the motorcycle 10 will now be described with reference to FIGS. 1-3. When cold starting the engine 12 on the motorcycle 10, an operator of the motorcycle 10 depresses the kick pedal 26 which accordingly results in rotation of the crankshaft 14 and resultant starting of the engine 12. If, after operating the engine 12 for some time, the engine 12 ceases rotation and requires restarting, if the temperature of the engine 12 has not reached a predetermined temperature, as measured by the temperature sensor 22, the operator of the motorcycle 10 may then restart the engine 12 by again using the kick pedal 26. However, if the temperature of the engine 12 has reached or exceeded the predetermined temperature, as measured by the temperature sensor 22, then the indicator 30 can provide a signal to the operator that electrical starting is available. The operator can then depress or otherwise actuate the starter switch 24 which provides power to the control contacts 34 and 35 of the relay 28, thereby resulting in the closing of the power input and output contacts 36 and 38 which facilitates flow of electrical power from the battery 16 to the electric starter motor 18 and resultant starting of the engine 12. Again, it will be appreciated that any of a variety of alternative electrical configurations can be provided to facilitate the operation of a power equipment apparatus in accordance with the teachings of the present invention.

An unheated or cold engine has a temperature below the predetermined temperature. Through operation of the engine (e.g., combustion of fuel within the piston cylinder(s)), the engine can become heated such that its temperature is at or above the predetermined temperature. This heating can occur within seconds or minutes from starting the engine. In some circumstances, a source of external heating (e.g., heating coils powered by a stationary power source) might be provided to heat or assist in heating the engine to the predetermined temperature.

The predetermined temperature can vary depending upon the characteristics of a particular engine, and also depending upon the desired power capacity of an electric starter motor and battery. For example, the predetermined temperature for a particular engine can generally increase as the size and power capacity of an electric starter motor and battery is decreased. In one particular embodiment, the predetermined temperature can be about 140° C., such that the temperature sensor provides a signal (e.g., the contacts of the temperature sensor 22 in FIG. 2 close) when the temperature of at least a portion of the engine reaches about 140° C. In another embodiment, the predetermined temperature can be in a range from about 120° C. to about 160° C. In still another embodiment, the predetermined temperature can be in a range from about 100° C. to about 200° C.

Figure 4:
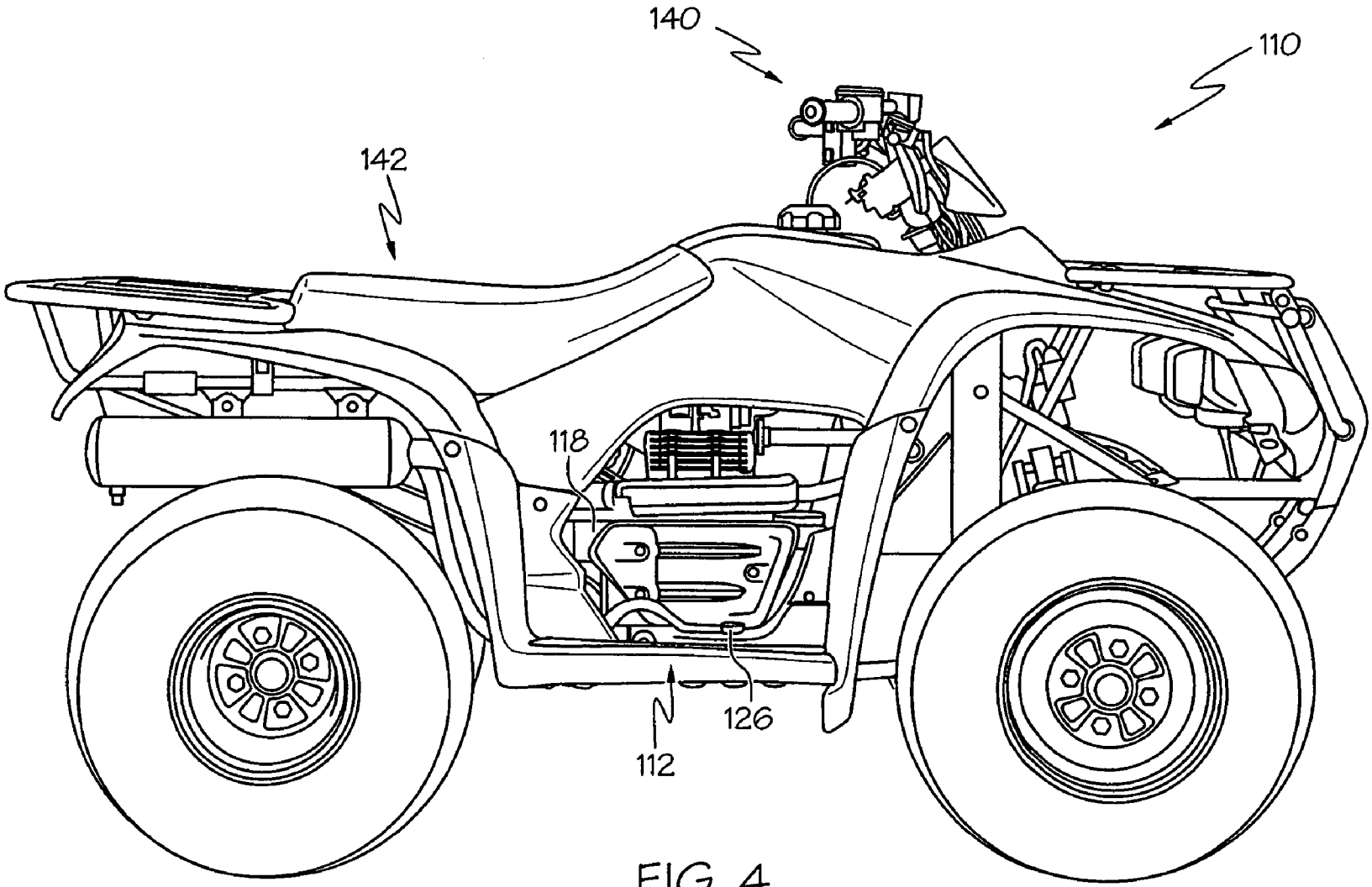
FIG. 4 is a side view depicting an all terrain vehicle ("ATV") in accordance with another embodiment of the present invention.

The motorcycle 10 described with respect to FIGS. 1-3 represents merely a single embodiment of a power equipment apparatus in accordance with the teachings of the present invention. As an example of another embodiment, FIG. 4 depicts an ATV 110 having an engine 112. The engine 112 can be started with either a kick pedal 126 or an electric starter motor 118. A starter switch for the electric starter motor 118 can be attached to a handlebar 140 of the ATV 110, perhaps adjacent to an indicator provided to advise an operator as to when a temperature of the engine 112 has reached or exceeds a predetermined temperature. The ATV 110 is also shown to include a seat 142 to support an operator of the ATV 110.

In still another embodiment of the present invention, a power equipment apparatus can comprise a push-type lawn mower having an engine, a manual starter mechanism (e.g., a pull-type rope), an electric starter motor, and a battery. In this configuration, the pull-type rope can be used to start the engine when the engine is cold. However, the electric starter motor and the battery may be used to restart the engine once the engine has adequately heated through use. As it is generally desirable to provide lawn mowers having minimal weight and cost, it will be appreciated that provision of a relatively small electric starter motor and battery upon a lawn mower can be advantageous as compared to conventional electric-start type lawn mowers which incorporate larger electric starter motors and batteries.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A power equipment apparatus comprising:

an engine;

means for manually starting the engine;

means for detecting a temperature of a portion of the engine; and means for selectively electrically starting the engine being operative only when the temperature exceeds a predetermined temperature.

2. The power equipment apparatus of claim 1 comprising a vehicle.

3. The power equipment apparatus of claim 2 wherein the means for manually starting the engine comprises a kick pedal.

4. The power equipment apparatus of claim 1 wherein the means for selectively electrically starting the engine is of insufficient power capacity to initiate cold starting of the engine.

5. The power equipment apparatus of claim 1 wherein the means for detecting comprises a thermally actuated switch.

6. The power equipment apparatus of claim 1 further comprising means for identifying to an operator the temperature relative to the predetermined temperature.

7. A power equipment apparatus comprising:

an engine having a crankshaft;

a battery;

an electric starter motor operatively coupled with the engine and configured to selectively initiate rotation of the crankshaft upon receipt of electrical power from the battery;

a manual starter mechanism comprising an actuator, the manual starter mechanism operatively coupled with the engine and configured to selectively initiate rotation of the crankshaft upon movement of the actuator by an operator;

a temperature sensor operatively coupled with the engine and configured to generate a temperature signal reflecting a temperature of a portion of the engine;

a starter switch configured for selective actuation by an operator; and a control system electrically coupled with each of the battery, the electric starter motor, the temperature sensor, and the starter switch, wherein the control system is configured to selectively facilitate passage of electrical power from the battery to the electric starter motor for actuation of the electric starter motor only when both the starter switch is actuated and the temperature exceeds a predetermined temperature.

8. The power equipment apparatus of claim 7 wherein the actuator of the manual starter mechanism comprises a kick pedal.

9. The power equipment apparatus of claim 8 comprising a motorcycle.

10. The power equipment apparatus of claim 8 comprising an all terrain vehicle.

11. The power equipment apparatus of claim 7 wherein at least one of the battery and the electric starter motor are of insufficient power capacity to initiate cold starting of the engine.

12. The power equipment apparatus of claim 7 wherein the temperature sensor comprises a thermally actuated switch.

13. The power equipment apparatus of claim 7 wherein the control system comprises a relay, and wherein the relay is configured to selectively facilitate passage of electrical power from the battery to the electric starter motor for actuation of the electric starter motor only when both the starter switch is actuated and the temperature exceeds a predetermined temperature.

14. The power equipment apparatus of claim 7 further comprising an indicator electrically coupled with the control system and configured to identify to an operator the temperature relative to the predetermined temperature.

15. The power equipment apparatus of claim 7 wherein the portion of the engine comprises an oil bath, and the temperature signal reflects a temperature of the oil bath.

16. The power equipment apparatus of claim 7 wherein the control system is configured to selectively facilitate passage of electrical power from the battery to the electric starter motor regardless of a state of charge of the battery.

17. A vehicle comprising:

an engine;

a battery;

an electric starter motor operatively coupled with the engine and configured to selectively facilitate electric starting of the engine;

a kick pedal operatively coupled with the engine and configured to selectively facilitate kick starting of the engine;

a temperature sensor operatively coupled with the engine and including contacts configured to selectively close during exposure of the temperature sensor to a temperature exceeding a predetermined temperature;

a starter switch including contacts configured to selectively close during actuation of the starter switch by an operator;

a relay having a control contact, a power input contact, and a power output contact, wherein the power input contact is connected for receiving electrical power from the battery, and the power output contact is connected for providing electrical power to the electric starter motor;

wherein the control contact is connected with a series connection of the temperature sensor and the starter switch.

18. The vehicle of claim 17 comprising a motorcycle.

19. The vehicle of claim 17 comprising an all terrain vehicle.

20. The vehicle of claim 17 wherein at least one of the battery and the electric starter motor are of insufficient power capacity to initiate cold starting of the engine.

21. The vehicle of claim 17 further comprising an indicator configured to identify to an operator the temperature relative to the predetermined temperature.

* * * * *